US011432584B2

(12) United States Patent
Conrady et al.

(10) Patent No.: US 11,432,584 B2
(45) Date of Patent: Sep. 6, 2022

(54) METHOD AND APPARATUS TO FORM A ROD FOR AN AEROSOL GENERATING ARTICLE FROM A SHEET OF MATERIAL

(71) Applicant: PHILIP MORRIS PRODUCTS S.A., Neuchatel (CH)

(72) Inventors: Jonas Conrady, Hamburg (DE); Rainer Dangers, Hamburg (DE); Peter Reuschel, Havekost (DE); Frank Syrzisko, Glinde (DE)

(73) Assignee: Philip Morris Products S.A., Neuchatel (CH)

( * ) Notice: Subject to any disclaimer, the term of this patent is extended or adjusted under 35 U.S.C. 154(b) by 174 days.

(21) Appl. No.: 16/613,937

(22) PCT Filed: May 18, 2018

(86) PCT No.: PCT/EP2018/063166

§ 371 (c)(1),
(2) Date: Nov. 15, 2019

(87) PCT Pub. No.: WO2018/211097

PCT Pub. Date: Nov. 22, 2018

(65) Prior Publication Data

US 2020/0337367 A1 Oct. 29, 2020

(30) Foreign Application Priority Data

May 18, 2017 (EP) ..... 17171822

(51) Int. Cl.
*A24C 5/18* (2006.01)
*A24D 3/02* (2006.01)

(52) U.S. Cl.
CPC ..... *A24C 5/18* (2013.01); *A24D 3/0204* (2013.01); *A24D 3/0229* (2013.01)

(58) Field of Classification Search
CPC ..... A24C 5/18; A24C 5/01; A24B 3/14
See application file for complete search history.

(56) References Cited

U.S. PATENT DOCUMENTS

| | | | |
|---|---|---|---|
| 4,170,347 | A | 10/1979 | Lewis |
| 4,189,511 | A | 2/1980 | Levers |
| 5,163,452 | A | 11/1992 | Marritt |

FOREIGN PATENT DOCUMENTS

| | | |
|---|---|---|
| DE | 102011004297 | 5/2012 |
| EP | 0482283 | 4/1992 |

(Continued)

OTHER PUBLICATIONS

Brochure, Sealution—TS1000 & GFC50, Hauni Korber Solutions, Apr. 2015, 8 pages.

(Continued)

*Primary Examiner* — Kelly M Gambetta
*Assistant Examiner* — Jennifer A Kessie
(74) *Attorney, Agent, or Firm* — Mueting Raasch Group

(57) ABSTRACT

The present invention relates to a method to form a rod for an aerosol generating article from a sheet of material (11), the method comprising the steps of: crimping the sheet of material (11); flattening the crimped sheet of material (11) by forcing it to contact a sliding edge, transversally arranged with respect to a feed direction of the sheet of material (11); giving a substantially tubular shape to the flattened sheet of material (11); and forming the rod with the so-shaped sheet of material (11). The present invention also relates to an apparatus to form a rod for an aerosol generating article from a sheet of material (11).

9 Claims, 4 Drawing Sheets

(56) References Cited

FOREIGN PATENT DOCUMENTS

| | | |
|---|---|---|
| EP | 1972553 | 1/2011 |
| GB | 879 537 | 10/1961 |
| JP | H04158776 | 6/1992 |
| WO | WO 2016/042100 | 3/2016 |
| WO | WO 2016/097016 | 6/2016 |

OTHER PUBLICATIONS

PCT Search Report and Written Opinion for PCT/EP2018/063166 dated Aug. 15, 2018 (12 pages).
International Preliminary Report on Patentability for PCT/EP2018/063166 dated May 9, 2019 (11 pages).
Office Action issued in Japan for Application No. 2019-556662 dated May 25, 2022 (10 pages). English translation included.

METHOD AND APPARATUS TO FORM A ROD FOR AN AEROSOL GENERATING ARTICLE FROM A SHEET OF MATERIAL

This application is a U.S. National Stage Application of International Application No. PCT/EP2018/063166 filed May 18, 2018, which was published in English on Nov. 22, 2018 as International Publication No. WO 2018/211097 A1. International Application No. PCT/EP2018/063166 claims priority to European Application No. 17171822.4 filed May 18, 2017.

The present invention is related to a method to form a rod for an aerosol generating article from a sheet of material. It is also is related to an apparatus to form a rod for an aerosol generating article from a sheet of material.

The material forming the sheet could be a homogenized tobacco material, TCL (Tobacco Cast Leaf), which is dried, and then cut in foils or sheets which are winded up into bobbins for storage and transport. Another material could be for instance PLA (Poly Lactic Acid), which is used to manufacture specific parts of aerosol generating articles' filters.

In a typical manufacturing process of aerosol generating articles, the sheet of material goes through a crimping process. The crimped sheet of material is then compressed into a rod which is cut into parts, usually tubular. These cut rods may form components of the aerosol generating articles.

The crimping process generally uses two rotating cylindrical rollers between which the sheet of material is pressed. These rollers typically have matching textured ridge-and-trough patterns on their outside surfaces that crimp the sheet.

The crimping process may influence the amount of air contact, the resistance to draw (RTD), and others, and, hence, is directly experienced by the users of the aerosol generating articles.

Another important effect of the crimping process is that the crimping breaks the structure and fibers of the material, which will help to compress the sheet of material into a rod. In particular, crimping elongates the material in which the sheet is formed to form longitudinal weakened lines of preferred folding. However, this weakening effect of the crimping on the material structure may have undesired effects.

As a consequence, applying an adequate crimping pressure is an important aspect of the crimping process. While a too low crimping pressure may decrease the positive effects of the crimping, a too high pressure could damage the sheet of material or decrease its tensile strength, which in turn may increase tearing occurrence and can even cause shredding.

The overall production process preferably runs at high speed. However, the shorter the crimping time, the more pressure has to be applied to assure a proper crimping of the sheet of material, which increases the risk to damage the sheet during the crimping process.

The resulting crimped sheet is then folded into rods and also preferably wrapped, for example in wrapping paper.

However, in particular for PLA material in sheet, the crimped sheet of material—after the folding—might try to expand back into an unfolded state, and this may result into a pressure applied to the wrapper, due to rigidity of the PLA sheet, thereby leading to stress on the wrapper or on glue closing the wrapper. This may possibly lead to a "popping up" of the wrapper closing the rod.

There is therefore a need for an apparatus and a method for forming a rod from a sheet of material in which folding of the sheet is controlled. Further, it is desired that stress and damages on the possible wrapping around the rod are limited.

In a first aspect, the invention relates to a method to form a rod for an aerosol generating article from a sheet of material, the method comprising the steps of: crimping the sheet of material; flattening the crimped sheet of material by forcing it to contact a sliding edge, transversally arranged with respect to a feed direction of the sheet of material; giving a substantially tubular shape to the flattened sheet of material; forming the rod with the so-shaped sheet of material.

The invention prepares the sheet of material to be compressed and to be folded from a sheet format to a rod format, in order to have a better controlled rod-forming process. This "preparation" takes place preferably after a crimping process to crimp the sheet of material and before the actual compression or folding of the crimped sheet into a rod. In the method of the invention, the sheet is preferably pulled at high speed. The sheet, which is preferably made of flexible material, may have then a flow like behavior. The sheet is put into contact, in this flow, to a sliding edge which "flattens" the material. Indeed, the sheet of material preferably includes grooves and ridges formed by the crimping process: these undulations formed by the groves and ridges are stretched by the sliding edge. After the stretching, the sheet is arranged into a cylindrical shape. In this way, the structure of the material is weakened by the flattening. Further, the sheet of material gets a tubular shape which is more compact than a planar sheet shape, and so it helps the compression process into a rod of the crimped sheet.

As used herein, the term "sheet" denotes a laminar element having a width and length substantially greater than the thickness thereof. The width of a sheet is preferably greater than about 10 millimeters, more preferably greater than about 20 millimeters or 30 millimeters. Even more preferably, the width of the sheet is comprised between about 100 millimeters and about 300 millimeters.

In a preferred embodiment, the sheet comprises poly lactic acid (PLA). The sheet may be a sheet of a material containing alkaloids. The sheet may be a sheet comprising homogenised tobacco material.

A "material containing alkaloids" is a material which contains one or more alkaloids. Among alkaloids, nicotine is a preferred one, which can be found in tobacco.

Alkaloids are a group of naturally occurring chemical compounds that mostly contain basic nitrogen atoms. This group also includes some related compounds with neutral and even weakly acidic properties. Some synthetic compounds of similar structure are also termed alkaloids. In addition to carbon, hydrogen and nitrogen, alkaloids may also contain oxygen, sulfur and, more rarely, other elements such as chlorine, bromine, and phosphorus.

Alkaloids are produced by a large variety of organisms including bacteria, fungi, plants, and animals. They can be purified from crude extracts of these organisms by acid-base extraction. Caffeine, nicotine, theobromine, atropine, tubocurarine are examples of alkaloids.

The most commonly used forms of homogenized tobacco material is reconstituted tobacco sheet and cast leaf. The process to form homogenized tobacco material sheets commonly comprises a step in which tobacco dust and a binder, are mixed to form a slurry. The slurry is then used to create a tobacco web. For example, by casting a viscous slurry onto a moving metal belt to produce so called cast leaf. Alternatively, a slurry with low viscosity and high water content can be used to create reconstituted tobacco in a process that resembles paper-making.

The sheet material of tobacco can be referred to as a reconstituted sheet material and formed using particulate tobacco (for example, reconstituted tobacco) or a tobacco particulate blend, a humectant and an aqueous solvent to form the tobacco composition. This tobacco composition is then typically casted, extruded, rolled or pressed to form a sheet material from the tobacco composition. The sheet of tobacco can be formed utilizing a wet process, where tobacco fines are used to make a paper-like material; or a cast leaf process, where tobacco fines are mixed together with a binder material and cast onto a moving belt to form a sheet.

The sheet of homogenized tobacco material may then be rolled in bobbins which are unwound in order to be further processed, to be part for example of an aerosol generating article, that is to be included in the aerosol-forming substrate of the aerosol generating article. A "heat-not-burn" aerosol generating article is a smoking article wherein an aerosol-forming substrate is heated to a relatively low temperature, in order to form an aerosol but prevent combustion of the tobacco material. Further, the tobacco present in the homogenized tobacco sheet is typically the only tobacco, or includes the majority of the tobacco, present in the homogenized tobacco material of such a "heat-not-burn" aerosol generating article. This means that the aerosol composition that is generated by such a "heat-not-burn" aerosol generating article is substantially only based on the homogenized tobacco material.

As used herein, the term "aerosol forming material" denotes a material that is capable of releasing volatile compounds upon heating to generate an aerosol. Tobacco may be classed as an aerosol forming material, particularly a sheet of homogenized tobacco comprising an aerosol former. An aerosol forming substrate may comprise or consist of an aerosol forming material.

The homogenized tobacco sheet generally includes, in addition to the tobacco, a binder and an aerosol-former. This composition may lead to a sheet which is "sticky", that is, it glues to adjacent objects, and at the same time it is rather fragile having a relatively low tensile strength.

As used herein, the term "crimped" denotes a sheet or web with a plurality of corrugations. The term "crimping" denotes the formation of a crimped sheet of material, preferable from an essentially flat sheet of material or a previously untreated sheet of material with respect of generating a structured surface.

As used herein, the term "amplitude value" or "amplitude" refers to the height of a corrugation from its peak to the deepest point of the deepest directly adjacent trough.

As used herein, the term "ridge" denotes a protrusion having a hill shape and forming a tip that may be either of a corner-type shape or of a rounded shape. The respective tip may be limited by two flanks, one on each side of the tip. The ridge or tip may have a certain extent.

As used herein, the term "corrugations" denotes a plurality of substantially parallel ridges formed from alternating peaks and troughs joined by corrugation flanks. This includes, but is not limited to, corrugations having a rhomboid-like profile, sinusoidal wave profile, triangular profile, sawtooth profile, or any combination thereof.

As used herein, the term "rod" denotes a generally cylindrical element of substantially circular or oval cross-section.

As used herein, the terms "axial" or "axially" refer to a direction extending along, or parallel to, the cylindrical axis of a rod.

As used herein, the terms "gathered" or "gathering" denote that a web or sheet is convoluted, or otherwise compressed or constricted substantially transversely to the cylindrical axis of the rod.

In the manufacturing process of the aerosol generating articles, the sheet of material may subjected to a crimping process.

During the crimping process, the sheet of material is usually pressed between two rotating cylindrical rollers, also called "crimping rollers". These rollers have matching textured ridges/grooves patterns on their outside surfaces that crimp the sheet of material. However, any crimping process may be used in the present invention.

The crimping process forms corrugations on the sheet of material. Due to the crimping, preferably the structure and fibers of the material of the sheet are broken. This breakage preferably helps to compress the sheet of material into a rod. In particular, crimping elongates the material in which the sheet is made to form longitudinal weakened lines of preferred folding. These lines are called corrugations.

After the crimping process in which the corrugations on the sheet are formed, there is a "preparation step" before gathering the crimped sheet and forming a rod from it. This preparation step includes flattening the crimped sheet due to the contact of the sheet to a sliding edge. The sliding edge is formed for example on a surface on which the sheet may slide.

The effect of the contact between the crimped sheet and the sliding edge is that the structure of the material may be weakened. The corrugations, when in contact with the edge, are "flattened". This flattening unfolds the crimped sheet, flattening the corrugations formed during the crimping process. In this way, the crimped portions of the sheet are weakened.

Further, after the flattening step, the sheet is preferably forced to fold into a cylindrical shape. This cylindrical shape has preferably a diameter greater than the diameter of the rod into which the sheet is compressed. In this way, there is a pre-compression of the sheet so that the sheet reaches the final rod shape in several steps. The achieved effect is that the sheet gets a tubular shape before the rod-forming step. Such tubular shape is more compact than a planar sheet shape, and it may help the compression process to a rod. The rod may be formed pulling the sheet into a funnel.

In order to force the sheet to form a tubular shape, an element having a tubular surface may be used. The sheet is put into contact to the tubular surface while travelling from the crimping to the rod forming apparatuses.

Further, these additional process steps of flattening and putting the sheet into a cylindrical or tubular shape are stable and can be easily reproduced, which may help to reach consistency in the compression of the sheet into a rod and thus to reach consistency also in the final product.

After bringing the sheet onto a cylindrical or tubular shape, the sheet is compressed to form a rod. The rod may be used as a component of an aerosol generating article. Preferably, the step of flattening the crimped sheet of material by forcing it to contact a sliding edge, transversally arranged with respect to a feed direction of the sheet of material, includes transporting the crimped sheet of material and putting it in contact with the sliding edge so that the sheet of material at least partly unfolds or extends. Advantageously, the crimped sheet of material contacts the sliding edge while the crimped sheet of material is transported forward in the manufacturing process.

Preferably, the sliding edge is included in a substantially planar sliding surface. Advantageously, also the substantially planar sliding surface helps to unfold or extend the sheet of material before the step of giving a substantially tubular shape to the flattened sheet of material. The substantially planar surface keeps the extension which has been achieved at the sliding edge.

Preferably, the substantially planar sliding surface is a textured surface. Advantageously, the textured surface decreases friction between the substantially planar sliding surface itself and the sheet of material. Preferably, the substantially planar sliding surface includes a plate having recesses, so that there are air gaps between the sheet of material and the plate.

Preferably, in the step of flattening the crimped sheet of material by forcing it to contact a sliding edge, transversally arranged with respect to a feed direction of the sheet of material, the sheet of material is tensioned. Advantageously, flattening the crimped sheet of material is performed by forcing a sliding contact between the sheet of material and the sliding edge, wherein the sheet of material is maintained in tension.

Preferably, the step of giving a substantially tubular shape to the flattened sheet of material includes folding the flattened sheet of material into a substantially cylindrical surface. Advantageously, the contact of the sheet of material with the substantially cylindrical surface efficiently gives the substantially tubular shape to the flattened sheet of material.

Preferably, the substantially cylindrical surface is connected with the substantially planar sliding surface. Advantageously, the substantially cylindrical surface and the substantially planar sliding surface can be formed as a single element, so that the steps of flattening the crimped sheet of material by forcing it to contact a sliding edge and of giving a substantially tubular shape to the flattened sheet of material are performed in an extremely compact space.

Preferably, the step of forming the rod with the so-shaped sheet of material includes inserting the sheet of material into a funnel to form the rod. Advantageously, the sheet material is compressed and folded in the funnel to form the rod.

In a second aspect, the invention relates to an apparatus to form a rod for an aerosol generating article from a sheet of material, the apparatus comprising: a crimping device for crimping the sheet of material; a funnel portion for forming the rod; a sliding edge, transversally arranged with respect to a feed direction of the sheet of material, wherein the sliding edge is placed between the crimping device and the funnel portion, so that the crimped sheet of material contacts the sliding edge before entering the funnel portion; and a tubular surface downstream the sliding edge in the feed direction to fold the sheet into a cylindrical shape.

Advantageously, the apparatus according to the invention is suitable to perform the method of the invention, with the advantages mentioned above. This apparatus is also extremely compact.

Preferably, the tubular surface is a cylindrical surface.

In particular, the apparatus according to the invention advantageously includes the sliding edge that abruptly bends and unfolds or extends the sheet of material before it enters the funnel portion. The bending and unfolding or extension of the sheet of material advantageously helps to increase the weakening effect of the crimping process on the sheet of material.

Preferably, the apparatus according to the invention includes a substantially planar sliding surface comprising the sliding edge. Advantageously, the substantially planar sliding surface helps to unfold or extend the sheet of material before it enters the funnel portion.

Preferably, the substantially planar sliding surface is a textured surface. Advantageously, the textured surface decreases friction between the substantially planar sliding surface itself and the sheet of material. In other words, the substantially planar sliding surface may comprise a plate having recesses, so that there are air gaps between the sheet of material and the plate.

Preferably, the substantially planar sliding surface forms an angle comprised between about 10° and about 70° with respect to the feed direction. More preferably, the angle is comprised between about 20° and about 60°, and even more preferably it is comprised between about 30° and about 50°. Preferably, the feed direction is a horizontal direction. Advantageously, it has been found that such angles may allow a convenient sliding contact with the sheet of material, so as to cause a good unfolding or extension of the sheet itself.

Preferably, the substantially cylindrical surface is connected with the substantially planar sliding surface. Advantageously, the substantially cylindrical surface and the substantially planar sliding surface can be formed as a single element, so that the apparatus is extremely compact.

Preferably, the crimping device includes crimping rollers.

The sheet of material mentioned above with reference to the first and second aspect of the invention is preferably a polymeric sheet or a sheet of material including alkaloids. More preferably, the sheet of material has a thickness comprised between about 0.2 millimetres and about 1.0 millimetre. More preferably, the thickness of the sheet of material is comprised between about 0.3 millimetres to 0.6 millimetres.

Further advantages of the invention will become apparent from the detailed description thereof with no-limiting reference to the appended drawings.

Figure 6:
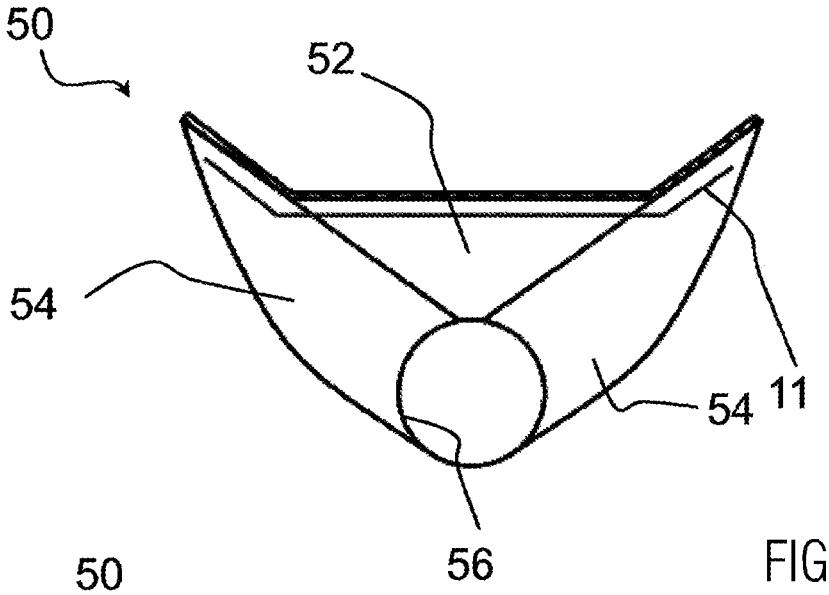
FIGS. 6-8 are schematic cross sections of the apparatus portion of FIG. 4, taken in the planes indicated with I-I, II-II, III-III in FIG. 4, respectively.
Figure 7:
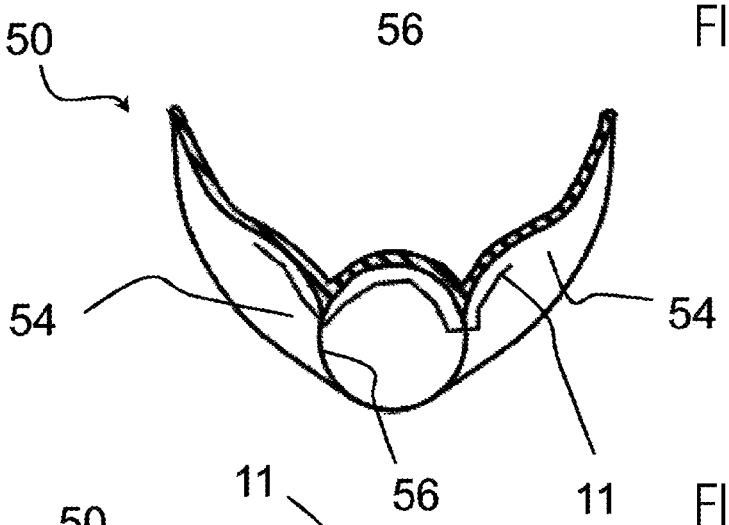
Figure 8:
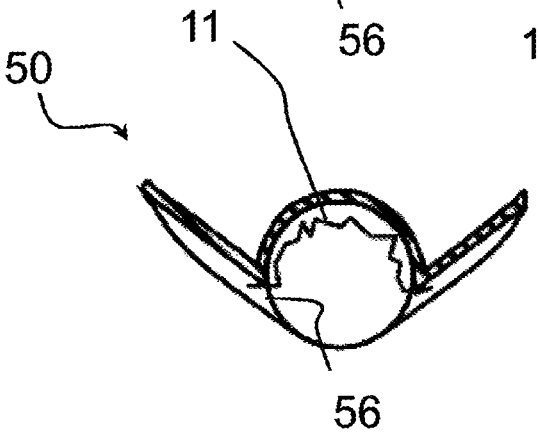

With reference to the figures, an apparatus according to the present invention is represented and indicated with reference number 10, the apparatus 10 being suitable to form a rod (not shown in the figures) for an aerosol generating article (also not shown) from a sheet 11 of material (schematically depicted with a curved line in FIGS. 6-8). Preferably, the sheet 11 of material is a polymeric sheet made of PLA. Preferably, the sheet of material has a thickness comprised between about 0.3 millimetres and about 0.6 millimetres.

Figure 1:
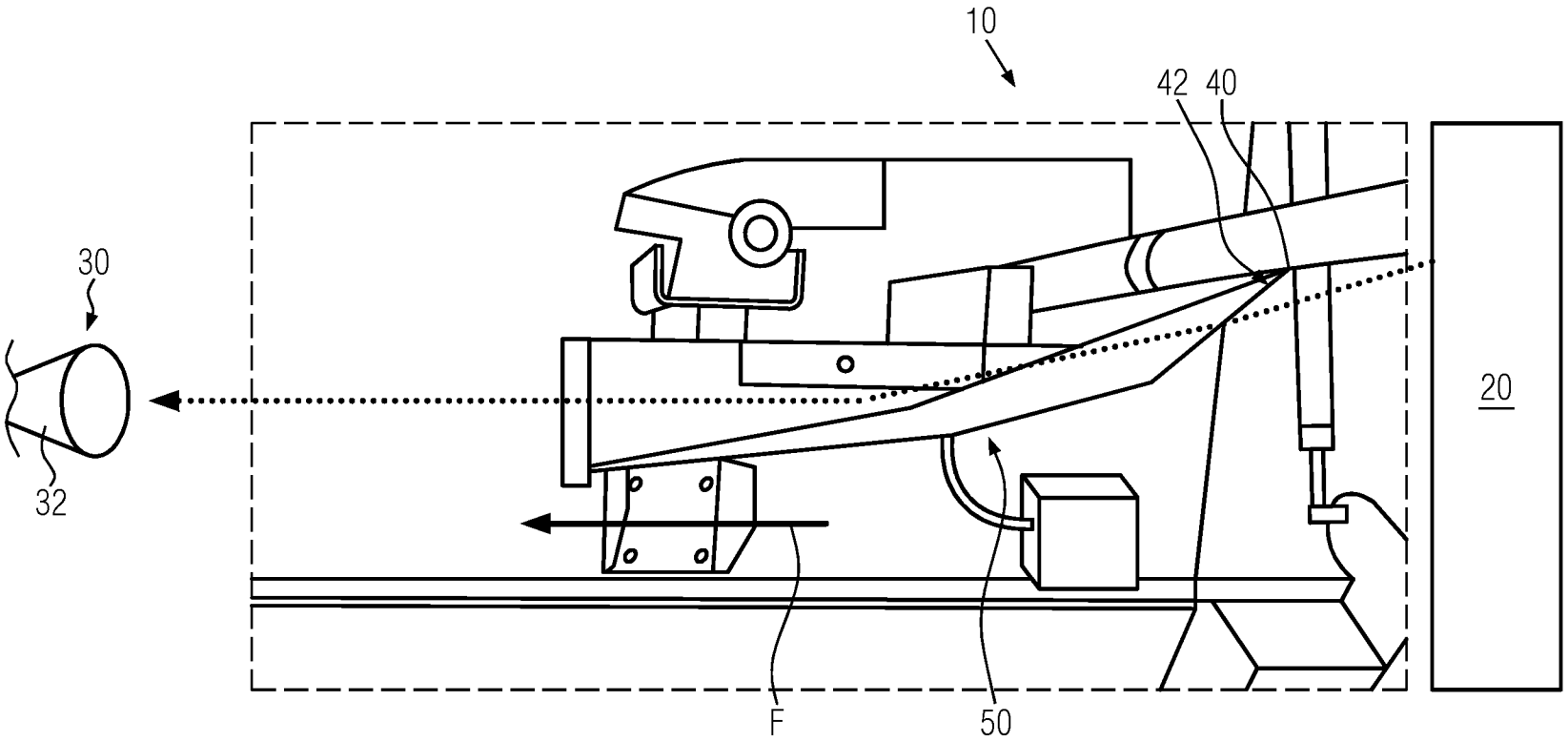
FIG. 1 is a schematic lateral view of an apparatus according to the invention to form a rod for an aerosol generating article from a sheet of material.

With reference to FIG. 1, the apparatus 10 comprises a crimping device 20 for crimping the sheet 11 of material and a funnel portion 30 for forming the rod. The crimping device 20 and the funnel portion 30 are known in the art and not further detailed below. The crimping device 20 includes crimping rollers (not shown in the figures) and the funnel portion 30 includes a funnel 32, wherein the sheet 11 is compressed into a rod. The sheet of material is transported along a feed direction F and it is first crimped in the crimping device 20, then processed as detailed below and then enters in the funnel portion 30 where it is compressed or folded into a rod. After passing through the crimping device 20, the sheet 11 includes a plurality of corrugations (not depicted in the drawings), usually including a ridge/grooves structure. These corrugations are substantially folds in the sheet.

The apparatus 10 also comprises a device 50 having a sliding edge 40. The device 50 is positioned between the crimping device 20 and the funnel portion 30, so that the crimped sheet 11 of material going from the crimping device 20 to the funnel portion 30 contacts the sliding edge 40 before entering the funnel portion 30.

The sliding edge 40 is transversally arranged with respect to the feed direction F of the sheet 11 of material. In FIG. 1, the sheet 11 of material goes from the right to the left, according to the direction of the arrow representing feed direction F.

Figure 5:
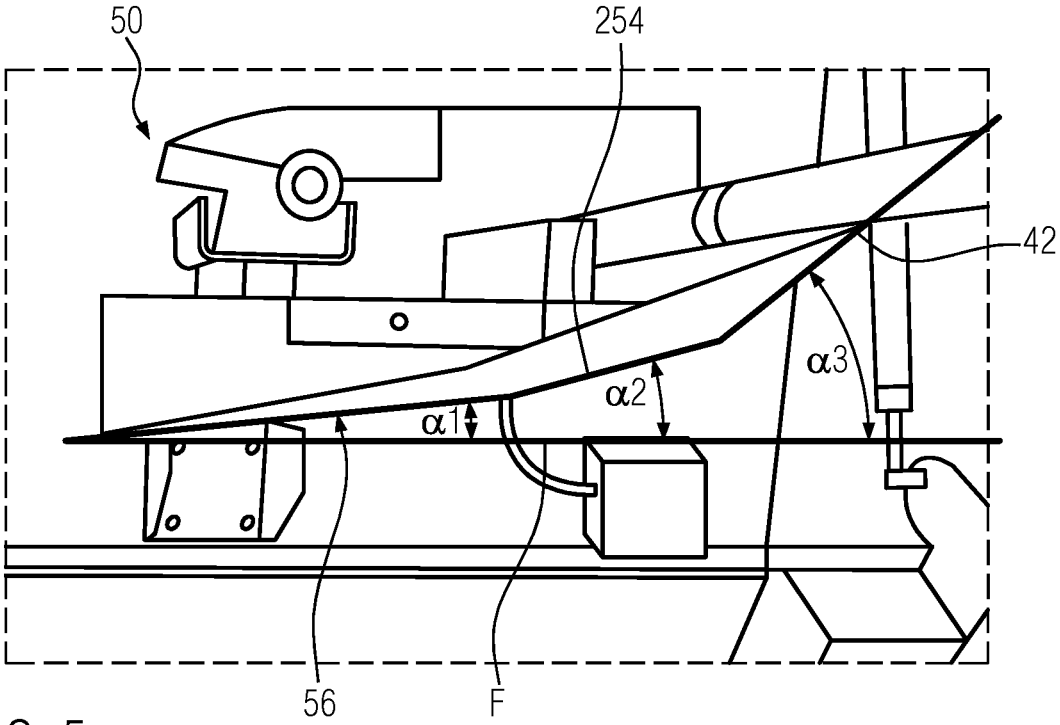
FIG. 5 is a schematic lateral view of the apparatus portion of FIGS. 2-4.

The device 50 includes a substantially planar sliding surface 42 comprising the sliding edge 40. Preferably, the substantially planar sliding surface 42 is a textured surface. As shown in FIG. 5, the substantially planar sliding surface 42 forms an angle $\alpha 3$ with respect to the feed direction F. Preferably, the angle $\alpha 3$ is comprised between about 10° and about 70°, more preferably is comprised between about 20° and about 60°, and even more preferably is comprised between about 30° and about 50°. Preferably, the feeding direction is a horizontal direction.

Furthermore, the device 50 includes a substantially cylindrical surface 44, which is provided between the sliding edge 40 and the funnel portion 30. The substantially cylindrical surface 44 is provided for giving a substantially tubular shape to the sheet 11 of material before it enters the funnel portion 30. The funnel 32 and the substantially cylindrical surface 44 are substantially coaxial, so that the sheet 11 of material is easily inserted into the funnel 32.

The substantially cylindrical surface 44 is connected with the substantially planar sliding surface 42 and preferably the two surfaces 42, 44 are formed in a single piece. Preferably the two surfaces are surfaces of an integral piece.

Figure 3:
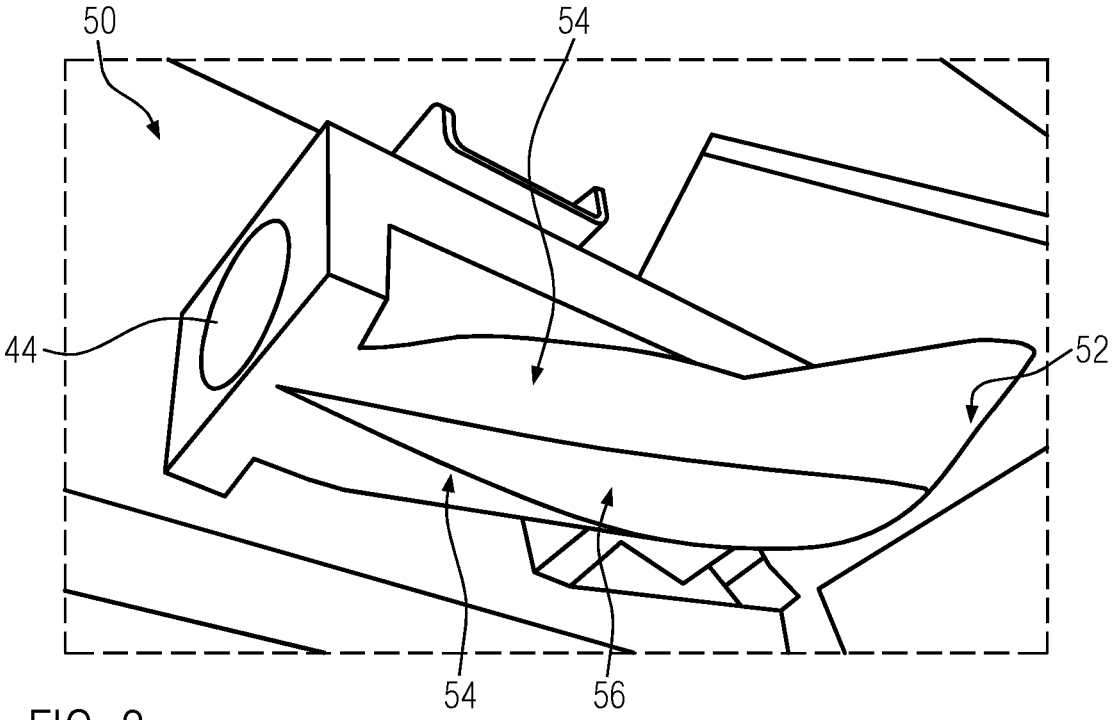

The device 50 including the sliding edge and the sliding surface comprises a body having front part 52, two side parts 54, and an inside part 56, better visible in FIG. 3. The body has a longitudinal axis, which corresponds to the feed direction F, and it is preferably substantially symmetrical with respect to the feed direction. Preferably, the longitudinal axis of the body of the device 50 is horizontal. Preferably, the body is an integral body, so that the front, sides and inside parts 52, 54, 56 are portions of the same body connected to each other.

In the following description, the sheet 11 of material moves along a horizontal feed direction F.

The front part 52 of the device 50 is the part that is the closest to the crimping device 20, from which the incoming sheet 11 arrives.

The front part 52 is placed above the incoming sheet 11. In other words, an upstream part of the device 50 is placed above the sheet 11.

The front part 52 includes the substantially planar sliding surface 42 which is substantially planar and forms the angle $\alpha 3$ with respect of the horizontal plane of the incoming sheet 11 or with respect to the feeding direction F.

In the preferred embodiment shown in the figures (in particular see FIG. 2), the planar sliding surface 42 substantially has a triangular shape including three vertexes 152, 252, 253. One 152 of the vertexes is in the bottom area of the front part 52 and the two other vertexes 252, 253 are in the upper area of the front part 52, which is the contact area where the sheet 11 begins to contact the device 50. The two vertexes 252, 253 are substantially placed at the same height and the sliding edge 40 is defined between them. Thus one side of the triangular shape of the sliding surface is the sliding edge 40. Other two sides 53, 53' are defined by edges connecting vertexes 152 and 252 as well as vertexes 152 and 253.

The front part 52 is placed above the sheet 11, i.e. the sheet 11 contacts and passes under the front part 52.

The two side parts 54 have similar shape, one being the symmetrical of the other according to a vertical plane passing through the feed direction F of the sheet 11. The two side parts extend at opposite sides of the front part surface for a portion along the feed direction F and are placed at the two sides of the inside part 56 for an additional portion along the feed direction F. The two side parts 54 keep the sheet converging towards the inside part 56.

The side parts 54 extend along the longitudinal axis of the device 50. Each side part 54 includes a curvy surface 154. The two curvy surfaces meet each other at their farthest point from the contact area of the front part 52. The curvy surfaces are tilted with respect to both a horizontal plane parallel to the feed direction and to a vertical plane. The two curvy surfaces form a converging element for the sheet towards the inside part. The two curvy surfaces are connected to the front part 52, and in particular each of them extends from one of the two sides 53, 53' of the triangular shape defined by the front part 52. Each curvy surface 154 then extends along the feed direction F towards the funnel portion 30 and in their extension the curvy surface "rotates" so that it becomes more and more horizontal.

Figure 2:
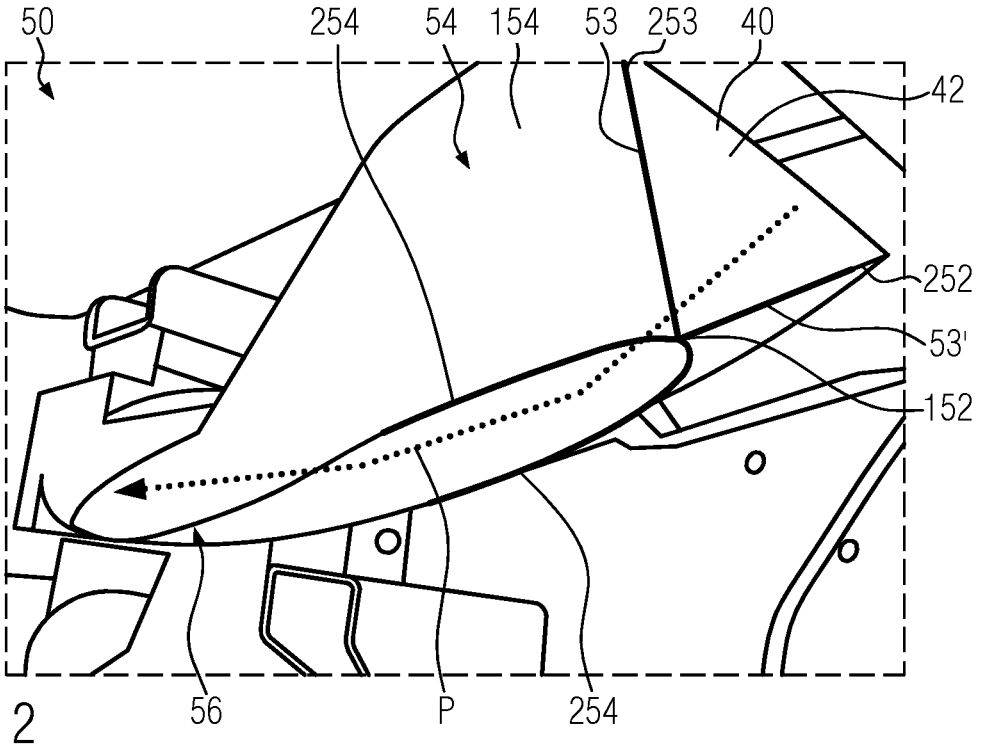
FIGS. 2-4 are schematic perspective views of a portion of the apparatus of FIG. 1.

In a lateral section taken along a plane parallel to the feed direction, each side part 54 defines a bottom curve 254. The bottom curve 254 is defined as a lowermost curve obtained sectioning the side part defined with a vertical plane. As shown in FIGS. 2 and 5, the bottom curve 254 of each side part 54 is substantially a vertically monotone decreasing function along the feed direction F of the sheet 11, decreasing of a predetermined vertical height along its extension.

The inside part 56 includes a portion of a horizontal tube surface having a longitudinal axis which is parallel to the feed direction F of the sheet 11. The substantially cylindrical surface 44 is defined in this horizontal tube surface.

The inside part 56 thus includes a surface that has the shape of the portion of an inner surface of a horizontal tube which is cut by a plane making an angle comprised between about 10° and about 70° with respect of the feed direction F of sheet F, for example with respect to a horizontal plane. Therefore, the inside part at the beginning of its extension includes a small portion of a cylindrical surface, and at its end it includes a whole closed cylindrical surface. From its beginning as a portion of cylindrical surface till it becomes closed, the inside part is connected at its two sides to the side parts. Therefore, the sheet 11 which comes into contact with the inside part coming from the front part, contacts an inside concave surface given by the portion of cylindrical surface and two convex surfaces given by the two curvy surfaces; the convex surfaces extend each from a side of the concave portion of cylindrical surface. The curvy convex surfaces form "lateral wings" to the portion of cylindrical surface and "push" the sheet towards the latter.

The horizontal tube (cut by a plane) formed in the inside part has a diameter which is substantially equal to the vertical decrease of the bottom curve 254 of the side part surface 54, that is, the diameter of the horizontal tube is preferably equal to the difference between the vertical ordinates of the bottom curve 254 at the beginning of the body 50 and at the end of the body 50.

The entrance zone of the portion of horizontal tube—where the incoming sheet 11 meets the portion of horizontal tube—touches the bottom area of the front part 52. The bottom area of the portion of horizontal tube touches the lowest areas of the side parts 54 of the device 50.

In the preferred embodiment shown in the figures (in particular see FIG. 2), the device 50 defines different edges, in addition to the sliding edge 40. In particular, there are two sharply formed edges, which are the two bottom curves 254, between the side parts 54 and the portion of horizontal tube of the inside part 56. There are also two edges 53, 53' formed between the front part 52 and the side parts 54. The two edges are the sides of the triangular-shaped front part.

In particular, FIG. 2 shows the device 50 from below, and the edges 53, 53', 254 can be seen. These edges 53, 254 stretch the sheet 11, the path of which is indicated by the dotted arrow P.

The described shape of the device 50 creates various effects on the flow of sheet 11 that is pulled into the device 50 by the overall machine into which the sheet 11 is processed. When started, the overall apparatus 10 pulls at high speed the sheet 11 through the crimping device so that corrugations are formed in the sheet 11. The sheet then passes through the device 50. The sheet 11 is made of flexible material so that it has a flow-like behaviour when passing into the device 50.

A first effect is that the structure of the material forming the sheet is weakened. The sheet 11 is flattened against the sliding edge 40. The sliding edge 40 unfolds the corrugations on the crimped sheet 11, thereby weakening the crimped portions of the sheet 11 when the sheet is further pulled along the edges 254 between the side parts 54 and the horizontal tube of the inside part 56.

A second effect is that the sheet 11 extends when it meets the front part 52 and the side parts 54. This extension, when done after the crimping, extends the structure of the material forming the sheet 11 which has, after the crimping, a ridges/grooves shape (or corrugated shape). This extension "smoothen" the ridges/grooves shape and so it helps to additionally break the structure of the material forming the sheet. This additional weakening of the material forming the sheet is done without having to increase the pressure or the depth of the crimping, and therefore without the related side effects of such increase of pressure which can damage or shred the material forming the sheet.

A third effect is that the sheet 11 gets a tubular shape inside the device 50. Such tubular shape is more compact than a planar sheet shape, and so it helps the compression process to a rod, and it is stable, which helps to reach consistency in the compression of the sheet 11 and therefore in the final product.

The surface of the device 50 in contact with the sheet material has preferably a textured surface that decreases friction between the device 50 and the sheet material.

FIG. 5 shows the lower profile of the device 50, corresponding to bottom curve 254 for the middle part where the side parts extend. Three different sections of the lower profile of the device 50 are substantially rectilinear and lie at three respective different angles $\alpha 1$, $\alpha 2$ and $\alpha 3$ with respect to the feed direction F. The angle $\alpha 3$ has been described above, while the angle $\alpha 2$ is preferably comprised between about 5° and about 30° and the angle $\alpha 1$ is preferably comprised between about 10° and about 20°.

The sheet 11 of material first passes over the section having the angle $\alpha 3$, then over the section having the angle $\alpha 2$ and finally over the section having the angle $\alpha 1$.

The angles $\alpha 2$ and $\alpha 3$ formed by the device 50 may provide a gradual transition and effective stretching, while the angle $\alpha 1$ is preferably relatively small to avoid sheet damage while the sheet 11 is entering in the portion of inside part 56 which form a closed cylindrical surface.

Figure 4:
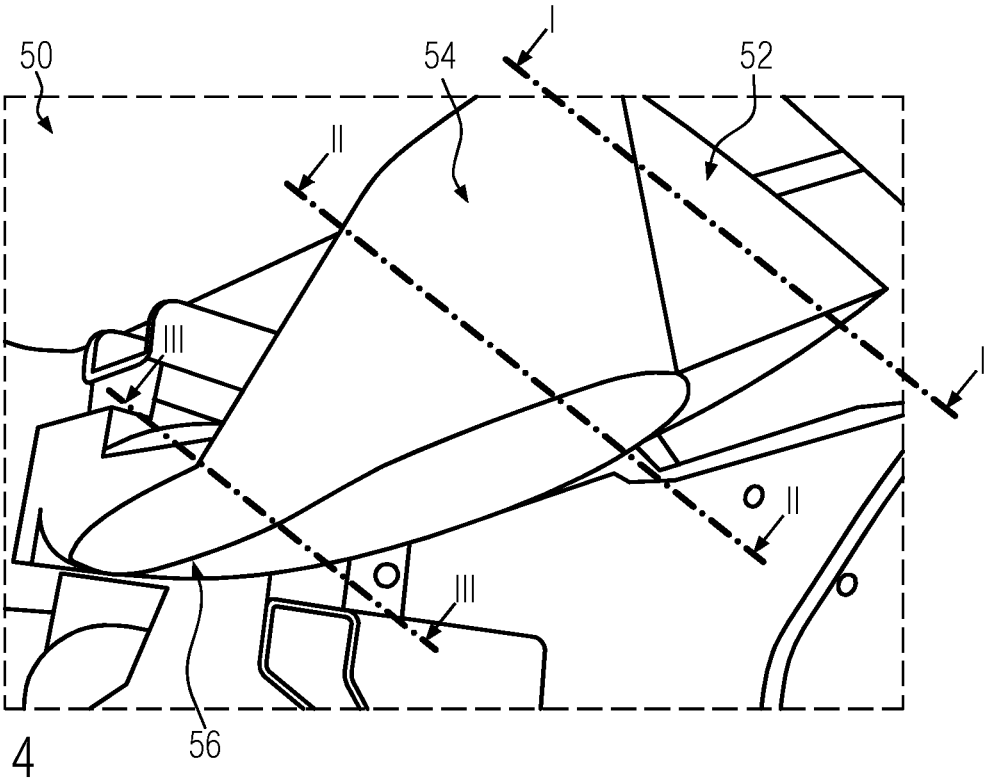

FIGS. 6-8 shows three cross sections of the device 50, taken in the planes indicated with I-I, II-II, III-III in FIG. 4, respectively. The plane I-I is located in the above-mentioned section having the angle $\alpha 3$, the plane II-II is located in the above-mentioned section having the angle $\alpha 2$ and the plane III-III is located in the above-mentioned section having the angle $\alpha 1$.

FIGS. 6-8 also shows the sheet 11 of material which is flattened at the front part 52 (FIG. 6) and then enters the inside part 56, wherein progressively takes the substantially tubular shape (FIGS. 7 and 8).

In operation, the apparatus 10 performs the following method to form a rod for an aerosol generating article from the sheet 11 of material, the method comprising the steps of: crimping the sheet 11 of material; flattening the crimped sheet 11 of material by forcing it to contact the sliding edge 40, transversally arranged with respect to the feed direction F of the sheet 11 of material; giving a substantially tubular shape to the flattened sheet 11 of material; and forming the rod with the so-shaped sheet 11 of material.

The step of flattening the sheet includes transporting the crimped sheet 11 of material and putting it in contact with the sliding edge 40 so that the sheet 11 of material at least partly unfolds and/or extends.

In the step of flattening the sheet, the sheet 11 of material is tensioned.

The step of giving a tubular shape to the sheet includes folding the flattened sheet 11 of material into the substantially cylindrical surface 44 of the device 50.

The step of forming the rod includes inserting the sheet 11 of material into the funnel 32 to form the rod.

In other words, the apparatus 10 comprises a preforming shoulder (including the sliding edge 40) which is arranged transversally to the sheet movement direction (feed direction F) and which is placed between crimping device 20 and the funnel portion 30 of the apparatus 10 itself, so that the crimped sheet 11 under tension slides over the preforming shoulder, before entering the funnel portion 30.

The invention claimed is:

1. A method to form a rod for an aerosol generating article from a sheet of material, the method comprising the steps of:

crimping the sheet of material;

flattening the crimped sheet of material by forcing it to contact a sliding edge, transversally arranged with respect to a feed direction of the sheet of material, including transporting the crimped sheet of material and putting it in contact with the sliding edge so that the sheet of material at least partly unfolds or extends;

giving a substantially tubular shape to the flattened sheet of material; and forming the rod with the so-shaped sheet of material.

2. The method according to claim 1, wherein the sliding edge is included in a substantially planar sliding surface.

3. The method according to claim 2, wherein the substantially planar sliding surface is a textured surface.

4. The method according to claim 1, wherein in the step of flattening the crimped sheet of material by forcing it to contact a sliding edge, transversally arranged with respect to a feed direction of the sheet of material, the sheet of material is tensioned.

5. The method according to claim 3, wherein the step of giving a substantially tubular shape to the flattened sheet of material includes folding the flattened sheet of material against a substantially cylindrical surface.

6. The method according to claim 5, wherein the substantially cylindrical surface is connected to the substantially planar sliding surface.

7. The method according to claim 1, wherein the step of forming the rod with the so-shaped sheet of material includes inserting the sheet of material into a funnel to form the rod.

8. The method according to claim 1, wherein the sheet of material is a polymeric sheet or a sheet of a material including alkaloids.

9. The method according to claim 1, wherein the sheet of material has a thickness comprised between about 0.2 millimetres and about 1.0 millimetre.

* * * * *